US006736685B2

(12) United States Patent
Gieseke

(10) Patent No.: US 6,736,685 B2
(45) Date of Patent: May 18, 2004

(54) STOWABLE INTEGRATED MOTOR PROPULSOR FINS

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/267,100

(22) Filed: Oct. 8, 2002

(65) Prior Publication Data

US 2004/0065248 A1 Apr. 8, 2004

(51) Int. Cl.[7] ..... F42B 19/01
(52) U.S. Cl. ..... 440/67; 114/23
(58) Field of Search ..... 114/144 R, 151, 114/23; 440/38, 40, 42, 43, 67

(56) References Cited

U.S. PATENT DOCUMENTS 3,162,162 A * 12/1964 Hamlin et al. ..... 114/23
4,145,877 A * 3/1979 Montgomery ..... 60/226.2
2002/0079404 A1 * 6/2002 Schroeder et al. ..... 244/3.3

* cited by examiner

*Primary Examiner*—Stephen Avila
(74) *Attorney, Agent, or Firm*—James M. Kasischke; Michael F. Oglo; Jean-Paul A. Nasser

(57) ABSTRACT

A control surface system is particularly well suited to provide improved control for undersea vehicles having integrated motor propulsors (IMP). The control surface system is deployable beyond lateral peripheral dimensions of the IMP and undersea vehicle. A plurality of arc-shaped control elements is disposed in a stowed position in an annular intake recess inside of an annular duct on the undersea vehicle. Struts connect each of the control elements to the annular duct. A deployment device rotates each of the control elements and the struts radially outwardly beyond lateral peripheral dimensions of the vehicle to a fully deployed position. A latching mechanism selectively engages and disengages the struts to hold the control elements in the stowed position and the fully deployed position, respectively. Launch tubes sized for the undersea vehicles can launch undersea vehicles provided with control surface system.

10 Claims, 4 Drawing Sheets

STOWABLE INTEGRATED MOTOR PROPULSOR FINS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to control surfaces for undersea vehicles. More particularly, this invention relates to control surfaces stowed in an annular intake recess on a vehicle and deployed outwardly to create large control surfaces.

(2) Description of the Prior Art

Elongate undersea vehicles, such as torpedoes are being used by many navies for offensive and defensive purposes. They are efficiently engineered to be compact, yet be able to carry heavy loads of ordnance or instrumentation packages over considerable distances. En route, they can be steered and maneuvered to intercept a distant moving target vessel or deliver the payload to a destination. Their propulsion systems have continued to improve over the years and one of these improvements is generally referred to as the integrated motor propulsor (IMP). Some typical IMPs and improvements related thereto are shown in U.S. Pat. Nos. 5,078,628, 5,205,653, 5,252,875, 5,220,231, 5,607,329, 5,649,811, and 5,702,273. An IMP can integrate an electric motor with the moving parts of a ducted propeller. Control surfaces cannot be added that extend beyond the periphery of the annular duct because the diameter of the propulsor then exceeds the constraints of contemporary tube-shaped launchers. Control surfaces should not interfere with the propulsor inflow and not influence the maximum propulsor diameter. In accordance with this invention it was discovered that better control surfaces for contemporary IMP vehicles improve control surface performance.

Some concepts for improving control surfaces might meet the requirements for minimal inflow disturbance and maximum diameter of the propulsor. These concepts include, 1) vectoring thrust, 2) mounting canard wings forward on the vehicle, 3) including wings which fold out from inside of the IMP duct, and 4) making a flexible vehicle (vehicle gimbaled in center). Although these concepts may meet some requirements for integration of control surfaces for an IMP, they do not completely eliminate inflow disturbances from the IMP, do not maximize available volume for the IMP, and do not lend themselves to simple control systems.

Thus, in accordance with this inventive concept, a need has been recognized in the state of the art for improved control surfaces for an IMP that do not interfere with inflow and outflow, allow launch from contemporary tube diameters, and do not rely on complicated systems.

OBJECTS AND SUMMARY OF THE INVENTION

The first object of the invention is to provide a control surface system for a torpedo-like undersea vehicle.

Another object is to provide a control surface system for an undersea vehicle propelled by an IMP.

Another object is to provide an improved control surface system for an IMP that does not interfere with inflow and outflow, allows launch from contemporary tube diameters, and does not rely on unduly complicating systems.

These and other objects of the invention will become more readily apparent from the ensuing specification when taken in conjunction with the appended claims.

Accordingly, the present invention is a control surface system particularly well suited to provide improved control for undersea vehicles having integrated motor propulsors (IMP). The control surface system is deployable beyond lateral peripheral dimensions of the IMP and undersea vehicle. Arc-shaped control elements are disposed in a stowed position in an annular intake recess inside of an annular duct on the undersea vehicle. Struts connect each of the control elements to the annular duct. A deployment device rotates each of the control elements and the struts radially outwardly beyond lateral peripheral dimensions of the vehicle to a fully deployed position. A latching mechanism, selectively engages and disengages the struts to hold the control elements in the stowed position and the fully deployed position, respectively.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENTS

Figure 1:
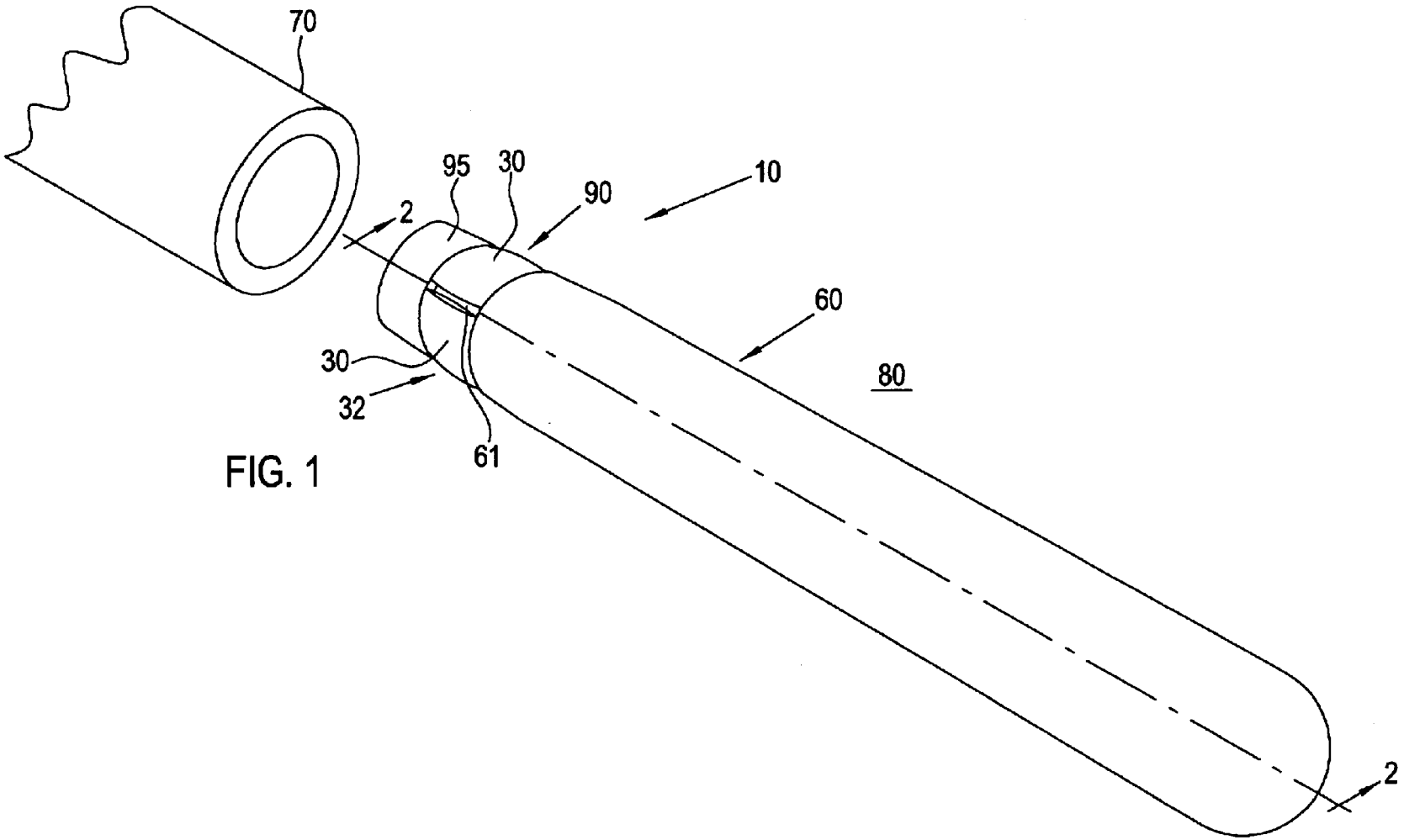
FIG. 1 is an isometric drawing showing the arc-shaped control elements of the invention in a stowed position in an annular recess of an undersea vehicle during launch of the vehicle.
Figure 2:
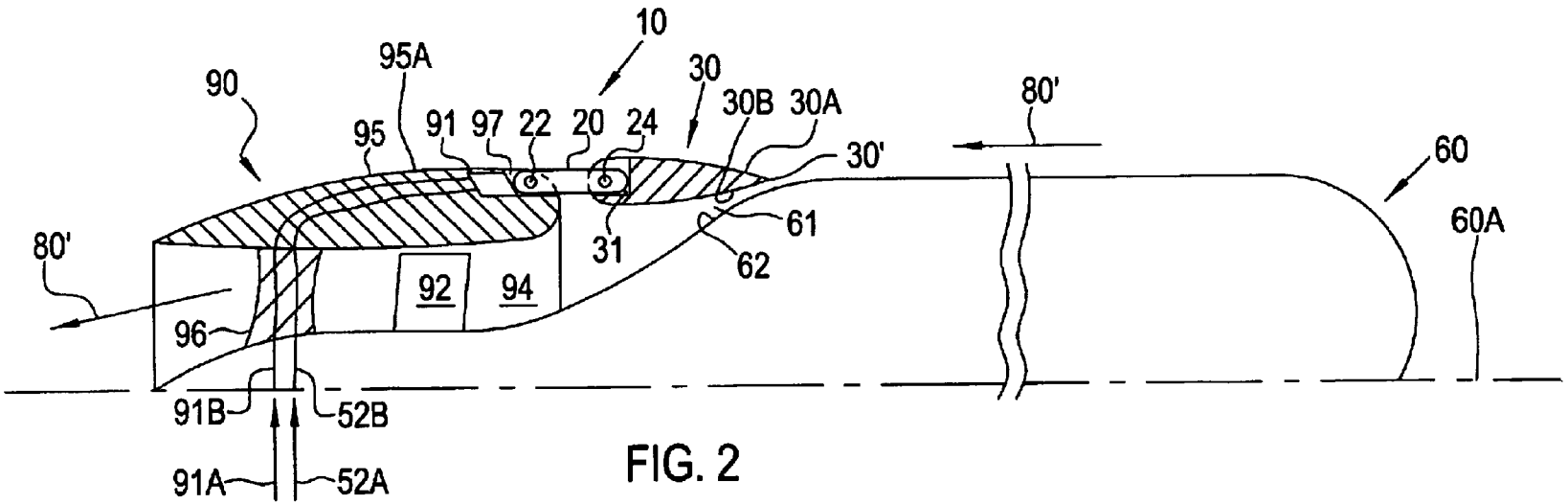
FIG. 2 is a partial cross-sectional view taken generally along line 2—2 in FIG. 1 schematically showing details of an upper strut and stowed control element of the invention.

Referring to FIGS. 1 and 2 of the drawings, control surface system 10 of the invention is mounted aft on a torpedo, or similar undersea vehicle 60 launchable from a standard launch tube 70 into ambient water 80. Control surface system 10 of the invention is shown in a retracted, or stowed position in an annular intake recess 61 adjacent to intake contour 62 on vehicle 60. This stowed position permits fitting and being retained in launch tube 70 prior to and during launch of vehicle 60 from launch tube 70.

Control surface system 10 is particularly well suited for vehicle 60 having an integrated motor propulsor (IMP) 90.

IMP 90 can be any one of many well-known designs having a rotor, or propeller 92 in an annular chamber 94 adjacent to annular intake recess 61 and inside of an annular duct 95. Annular duct 95 is mounted on vehicle 60 by at least one hydrofoil-shaped structural member 96, although for such structural members 96 are included in this embodiment. This design can achieve maximum propulsor performance and motor power density inside of duct 95 that can have a hydrofoil shape if the duct is as large as possible and its outer surface 95A equals the outer diameter (lateral peripheral dimensions) of vehicle 60.

Control surface system 10 has a set of four streamlined hydrofoil-shaped struts 20 orthogonally disposed about vehicle 60. Each strut 20 is secured to a lateral pin 22 which is pivotally connected to annular duct 95 extending across a slot 97 formed in annular duct 95. The other end of each strut 20 is secured to a lateral pin 24 and is pivotally connected to the middle of a separate arc-shaped control element 30. Lateral pin 24 extends through a separate slot 31 formed in each control element 30. The four curved, or arc-shaped control elements 30 have first and second surfaces 30A, 30B on their opposite sides. These arc-shaped control elements 30 make up segments or sections of a streamlined segmented duct 32 that occupies annular intake recess 61 when control elements 30 are stowed in a retracted position. When stowed, each control element 30 is secured by a separate latching mechanism 91 located in annular duct 95. Arc-shaped control elements 30 are curved allowing conformance of their outer first surfaces 30A to the outermost radius of vehicle 60. This sizing and fitting of control elements 30 allows control elements 30 to be large to enhance control capabilities when they are deployed without affecting the outer diameter of undersea vehicle 60.

Figure 3:
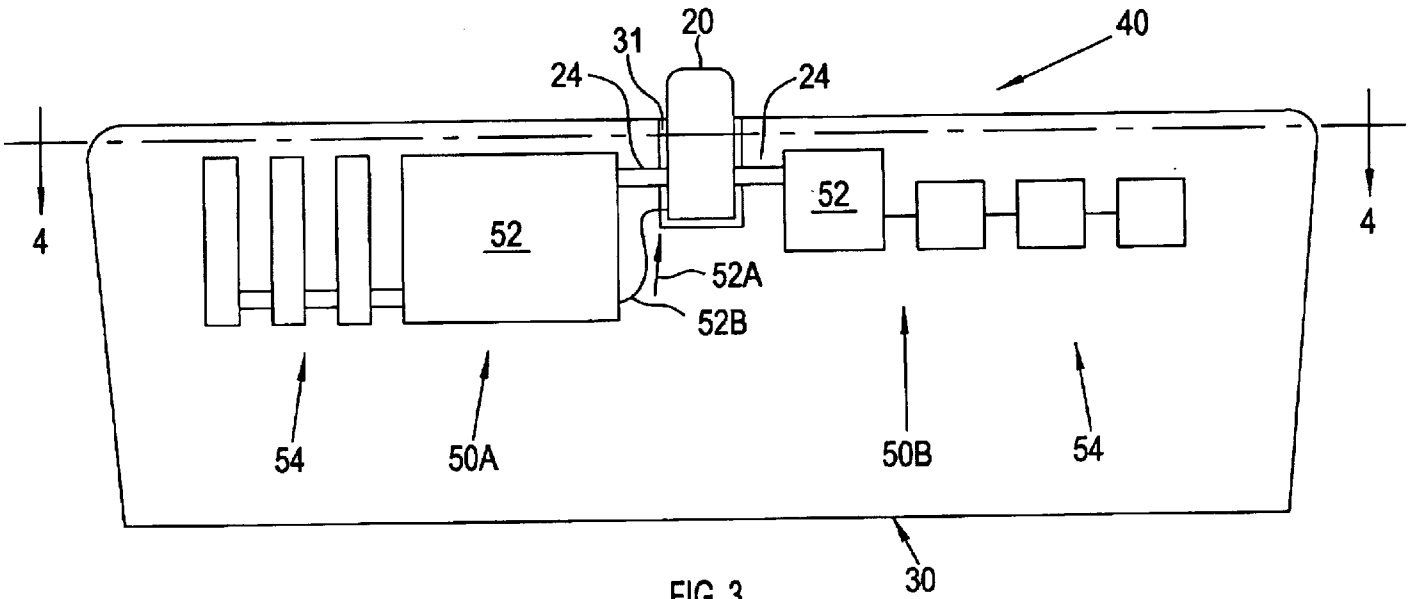
FIG. 3 is a cross-sectional top view of an arc-shaped control element in the deployed position schematically showing details of exemplary articulating modules of a steering assembly.
Figure 4:
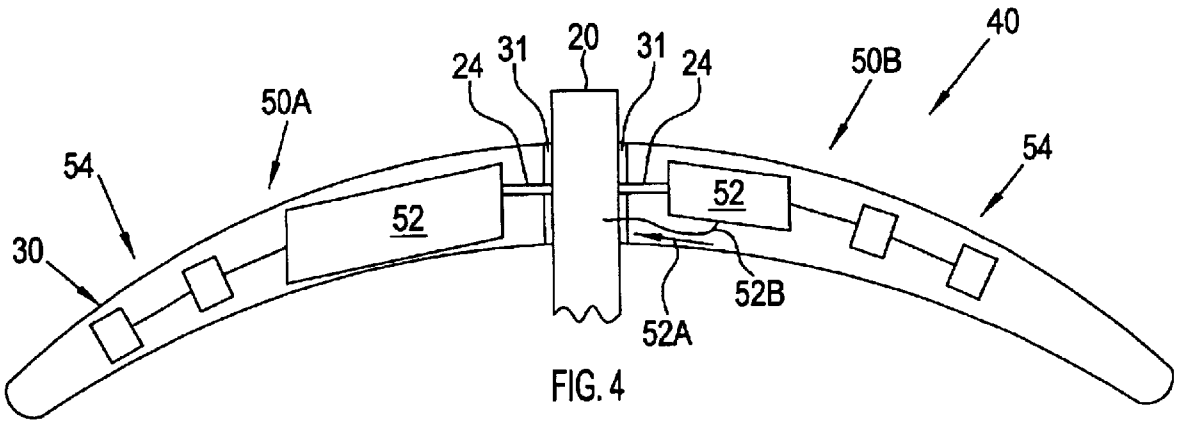
FIG. 4 is a cross-sectional front view taken generally along line 4—4 in FIG. 3 schematically showing details of the exemplary actuation mechanism of the arc-shaped control element in the deployed position.

Referring additionally to FIGS. 3 and 4 each control element 30 has a steering assembly 40 therein for responsively articulating, or rotating control element 30 to steer and maneuver vehicle 60 after control element 30 has been fully deployed beyond the lateral peripheral dimensions of vehicle 60. Each steering assembly has a pair of articulation modules 50A, 50B that each includes an actuator unit 52 connected to batteries 54. Actuator unit 52 preferably includes a motor and gearbox; however, other devices such as solenoids, smart materials or the like could be used. Although only one articulation module 50A or 50B might be selected, two modules 50A, 50B are more likely to be used to overcome the forceful resistance created by flowing fluid 80' on control elements 30 as vehicle 60 travels through water 80.

Articulation modules 50A, 50B are completely contained within each control element 30. Both actuator units 52 from both articulation modules 50A, 50B of each steering assembly 40 can be connected to engage lateral pin 24 and/or strut 20. These units 52 can selectively and responsively rotate each interconnected control element 30 in opposite directions as shown by arrows 99 (FIG. 6) to steer and maneuver vehicle 60. Such rotation is imparted in response to control signals shown as arrows 52A transmitted over control leads 52B extending to units 52 through strut 20, annular duct 95 and structural member 96 from a control module (not shown) in vehicle 60.

Figure 5:
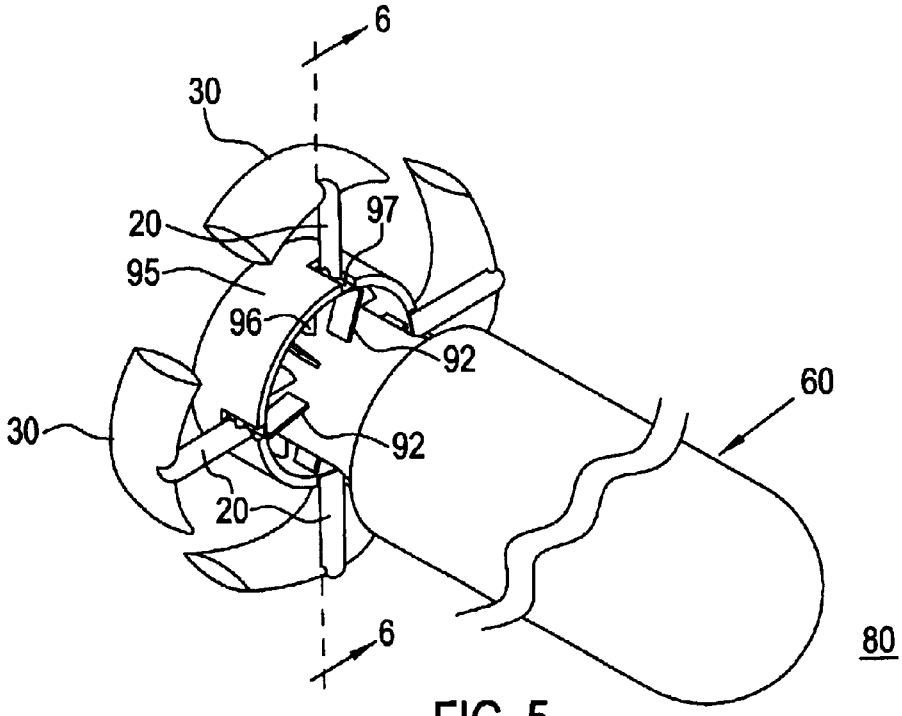
FIG. 5 is a schematic, isometric showing of the stowable control elements of the invention in a position deployed radially outwardly beyond the lateral peripheral dimensions of the undersea vehicle.

In a first embodiment, steering assemblies 40 can be used to deploy control elements 30 to the fully deployed position radially outwardly from vehicle 60 as shown in FIG. 5. Steering assemblies 40 can rotate edges 30' of control elements 30 counter-clockwise out of the stowed position as shown in FIG. 1 and away from vehicle 60. This rotational displacement causes edge 30' and second control surface 30B of control elements 30 to be exposed to a force created by flowing water 80' as vehicle 60 is propelled through water 80 by rotor 92 of IMP 90. The pushing force exerted on control surfaces 30B by flowing water 80' can be used to complete rotation of control elements 30 from the stowed position shown in FIGS. 1 and 2 to the fully deployed position of FIG. 5.

Figure 6:
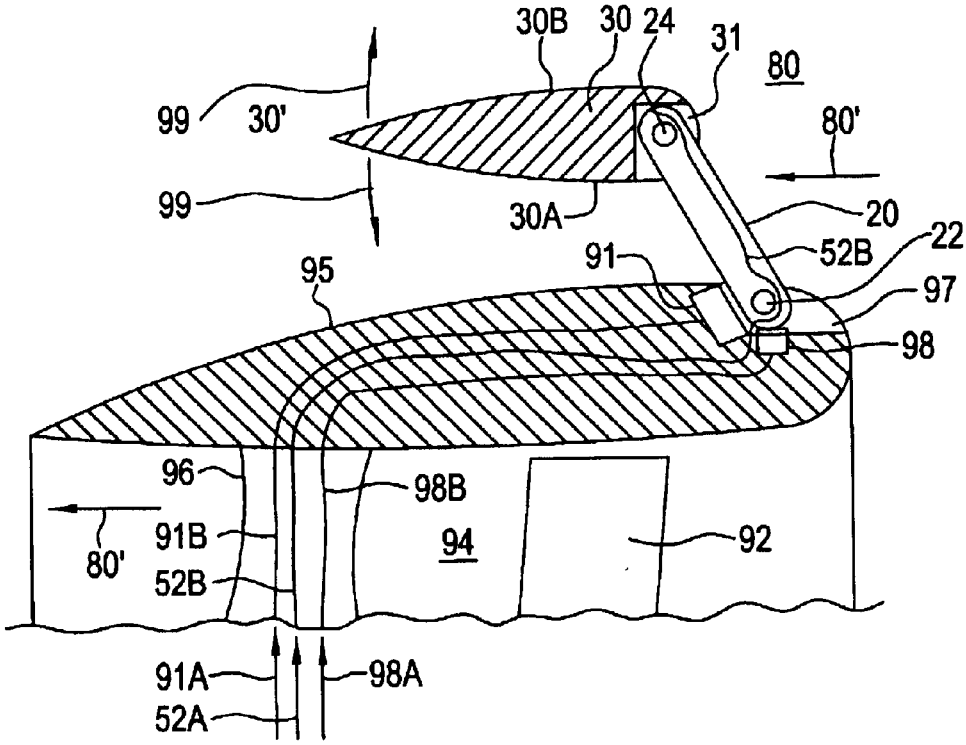
FIG. 6 is a cross-sectional view taken generally along line 6—6 in FIG. 5 schematically showing details of a deployed upper strut and control element of the invention.

In a second embodiment, an extending mechanism 98 can be provided in contact with each strut 20 and in combination with steering assembly 40 for deployment. Extending mechanisms 98 (only one of which is schematically shown in FIG. 6) can be small electric motor-gear-box combinations in annular duct 95 that each engage a separate strut 20 and/or lateral pin 22. This mechanism 98 can hold each control element 30 in its stowed position in annular intake recess 61, see FIGS. 1 and 2. In addition, each extending mechanism 98 can rotate a separate strut 20 in response to control signals shown as arrow 98A over control lead 98B extending to the control module. Rotation of all of struts 20 around the longitudinal axis of lateral pins 22 in response control signals 98A will deploy control elements 30 radially outwardly from longitudinal axis 60A of vehicle 60 to fully deployed positions shown. Steering assembly 40 can orient control element 30. Instead of a motor, extending mechanism 98 can also include a coiled biasing spring selectively released by appropriate control signals to use its biasing force to rotate a separate strut 20 and control element 30 to the fully deployed position of FIGS. 5 and 6.

The latching mechanism 91 associated with each strut 20 also acts as a stop to prevent further rotation of each strut 20 and engages each strut 20 to secure, or fix it at the fully deployed position. Latching mechanism 91 can be any of many such mechanisms freely available in the art. As mentioned above, latching mechanism 91 can also engage each strut 20 when each control element 30 is in the stowed position of FIGS. 1 and 2. Appropriate control signals 91A over a lead 91B extending to a control module in vehicle 60 can actuate latch mechanism 91 to selectively disengage or engage strut 20. Steering assemblies 40 and flowing ambient water 80' over vehicle 60 and through annular chamber 94 can both be used to displace control elements 30 to the fully deployed position. Extending mechanisms 98 can act as a damper to prevent control elements 30 from being too rapidly extended, or deployed. This damping assures that they will not be damaged as they otherwise might forcefully impact the stop created by latching mechanism 91.

Four struts 20 and control elements 30 with associated modules have been described. It is understood that different numbers of differently shaped struts and control elements could be made in accordance with this invention to allow large control elements 30 to be deployed and stowed in a relatively small volume within the dimensions of undersea vehicle 60. In addition, other mechanisms, controls, and actuation approaches could be selected by one skilled in the art to which this invention applies without departing from the scope of this invention herein described. The invention disclosed herein can be applied to more conventional undersea vehicles having long proven conventional propulsion systems instead of IMP 90. Having this disclosure in mind, selection of suitable components from among many proven contemporary designs and compactly interfacing them on vehicle 60 can be readily done without requiring anything beyond ordinary skill.

The disclosed components and their arrangements as disclosed herein contribute to the novel features of this invention. Control surface system 10 of this invention provides a reliable and cost-effective means to improve the reliability and responsive operation of many different undersea vehicles 60. Therefore, control surface system 10 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A control surface system for an undersea vehicle comprising:

an annular duct positionable on an undersea vehicle;

a plurality of struts pivotally joined to said annular duct;

a plurality of arcuate control elements each having control surfaces and each being pivotally joined to a separate one of said struts; and deploying means positioned in each control element and joined to a separate one of said struts, said deploying means pivoting each control element and strut outward from a stowed position where said combined control elements have a diameter coincident with a general exterior diameter of the undersea vehicle to a fully deployed position where said combined control elements extend out beyond the general exterior diameter of the undersea vehicle.

2. The system of claim 1 wherein said deploying means includes an articulation-steering means moving the control elements from an arrangement as a streamlined segmented-duct in said stowed position into flowing ambient water to said fully deployed position for imparting responsive rotation of each control element to steer and maneuver said vehicle through said ambient water.

3. The system of claim 2 further comprising a latching means joinable between each strut and said annular duct selectively engaging and disengaging said strut to hold said strut in said stowed position and said fully deployed position, respectively.

4. A control surface system for an undersea vehicle comprising:

an annular duct positionable on an undersea vehicle;

a plurality of struts pivotally joined to said annular duct;

a plurality of arcuate control elements each having control surfaces and each being pivotally joined to a separate one of said struts; and deploying means positioned in said annular duct and joined to said struts, said deploying means pivoting each control element and strut outward from said vehicle from a stowed position where said combined control elements have a diameter coincident with a general exterior diameter of the undersea vehicle to a fully deployed position where said combined control elements extend out beyond the general exterior diameter of the undersea vehicle.

5. The system of claim 4 wherein said deploying means is a plurality of motors each joined to a separate strut to move the control elements from an arrangement of a streamlined segmented duct in said stowed position into flowing ambient water.

6. The system of claim 5 further comprising a latching means joinable between each strut and said annular duct selectively engaging and disengaging each strut to hold each strut in said stowed position and said fully deployed position, respectively.

7. The system of claim 6 further comprising a steering means in each control element for imparting responsive rotation of each control element to steer and maneuver said vehicle through said ambient water.

8. The system of claim 5 further comprising a latching means joinable between each strut and said annular duct selectively engaging and disengaging each strut to hold each strut in said stowed position and said fully deployed position, respectively.

9. The system of claim 8 further comprising a steering means in each control element for imparting responsive rotation of each control element to steer and maneuver said vehicle through said ambient water.

10. A control surface system for an undersea vehicle comprising:

an annular duct positionable on an undersea vehicle;

a plurality of struts joined to said annular duct;

a plurality of arcuate control elements each having control surfaces and each being joined to a separate one of said struts; and deploying means positioned in said annular duct and joined to said struts, said deploying means moving each control element and strut from said vehicle from a stowed position to a fully deployed position wherein said deploying means is a plurality of springs each joined to a separate strut for moving the control elements from an arrangement of a streamlined segmented duct in said stowed position into flowing ambient water.

* * * * *